United States Patent [19]

DeSalvo et al.

[11] Patent Number: 4,829,846

[45] Date of Patent: May 16, 1989

[54] MARINE PROPULSION DEVICE WITH RELEASABLE SHIFT HANDLE

[75] Inventors: Sal P. DeSalvo, Antioch; Gregory D. Irwin, Lindenhurst; Matthew H. Mondek, Wonder Lake; Louis R. Neal, Zion; Verdun W. Oglesby, Waukegan; Robert W. Woodard, Waukegan, all of Ill.

[73] Assignee: Outboard Marine Corporation, Waukegan, Ill.

[21] Appl. No.: 165,421

[22] Filed: Feb. 29, 1988

Related U.S. Application Data

[63] Continuation of Ser. No. 843,000, Mar. 24, 1986, abandoned.

[51] Int. Cl.[4] ..... G05G 1/10; B60L 11/02; B63H 5/12; B63H 21/26

[52] U.S. Cl. ..... 74/547; 114/146; 440/6; 440/53; 74/543

[58] Field of Search ..... 74/551.9, 544, 531, 74/480 B, 547; 114/146 X; 440/6 X, 7, 53 X

[56] References Cited

U.S. PATENT DOCUMENTS

| | | | |
|---|---|---|---|
| 2,478,858 | 8/1949 | Buske | 440/53 |
| 2,732,819 | 1/1956 | Irgens | 440/53 |
| 2,747,425 | 5/1956 | Ohlau | 114/162 |
| 3,091,978 | 6/1963 | Rubinstein | 74/547 |
| 3,313,386 | 4/1967 | Schwalm | 193/22 |
| 3,383,945 | 4/1968 | Carella | 74/547 |
| 3,436,987 | 4/1969 | Baxter | 74/547 |
| 3,483,769 | 12/1969 | Bouthors et al. | 74/547 |
| 3,955,438 | 5/1976 | Zakrzewski | 74/551.9 |
| 3,995,650 | 12/1976 | DiVito | 74/551.9 |
| 4,386,918 | 6/1983 | Matthews et al. | 440/7 |
| 4,412,826 | 11/1983 | Jones et al. | 404/86 |
| 4,500,298 | 2/1985 | Hall et al. | 114/162 |
| 4,563,155 | 1/1986 | Blanchard | 114/162 |
| 4,624,206 | 11/1986 | Frye et al. | 74/531 |

*Primary Examiner*—Richard E. Moore
*Assistant Examiner*—Vinh Luong
*Attorney, Agent, or Firm*—Michael, Best & Friedrich

[57] ABSTRACT

A marine propulsion device comprising a mounting bracket adapted to be mounted on the transom of a boat, a propulsion unt mounted on the mounting bracket for pivotal movement relative thereto about a generally vertical steering axis, the propulsion unit including a pivotally mounted propeller and an engine drivingly connected to the propeller by a transmission, and a shift handle assembly including an inner member mounted on the propulsion unit for movement relative thereto, the inner member being connected to the transmission for actuation of the transmission in response to movement of the inner member, an outer member movable between spaced first and second positions relative to the inner member, and a bolt for securing the outer member in the first position so as to cause movement of the inner member in response to movement of the outer member, and for selectively permitting movement of the outer member to the second position.

15 Claims, 1 Drawing Sheet

MARINE PROPULSION DEVICE WITH RELEASABLE SHIFT HANDLE

RELATED APPLICATION

This application is a continuation of application Ser. No. 843,000, filed Mar. 24, 1986, now abandoned.

BACKGROUND OF THE INVENTION

The invention relates to handles, and, more particularly, to handles for shifting or actuating a transmission. Still more particularly, the invention relates to shift handles for marine propulsion devices.

It is known in the marine art to provide outboard motors with shift handles that extend upwardly from the propulsion unit and adjacent the engine cowl assembly. This arrangement presents a problem if the cowl assembly is split along a vertical plane since the upwardly extending shift handle will interfere with removal of the cowl assembly.

Attention is directed to the following U.S. Pats. Nos.:

| | | |
|---|---|---|
| Bouthors, et al | 3,483,769 | December 16, 1969 |
| Rubinstein | 3,091,978 | June 4, 1963 |
| Jones, et al. | 4,412,826 | November 1, 1983 |
| Baxter | 3,436,987 | April 8, 1969 |
| Carella | 3,383,945 | May 21, 1968 |
| Schwalm | 3,313,386 | April 11, 1967 |

SUMMARY OF THE INVENTION

The invention provides a marine propulsion device comprising a mounting bracket adapted to be mounted on the transom of a boat, a propulsion unit mounted on the mounting bracket for pivotal movement relative thereto about a generally vertical steering axis, the propulsion unit including a pivotally mounted propeller and an engine drivingly connected to the propeller by a transmission, and a shift handle assembly including an inner member mounted on the propulsion unit for movement relative thereto, the inner member being connected to the transmission for actuation of the transmission in response to movement of the inner member, an outer member movable between spaced first and second positions relative to the inner member, and means for securing the outer member in the first position so as to cause movement of the inner member in response to movement of the outer member, and for selectively permitting movement of the outer member to the second position.

In the disclosed embodiments, the inner member is mounted on the propulsion unit for rotation about a first axis, and the securing means secures the outer member in the first position relative to the inner member so as to cause rotation of the inner member in response to movement of the outer member.

Also in the disclosed embodiments, the securing means selectively permits rotation, about a second axis, generally parallel to and radially spaced from the first axis, of the outer member to the second position.

Also in the disclosed embodiments, the securing means includes interengaging means located on the outer member and on the inner member and operable when the outer member is in the first position for causing rotation of the inner member in response to movement of the outer member, and means for connecting the outer member to the inner member in the first position, and for selectively permitting movement of the outer member from the first position and along the second axis so as to cause disengagement of the interengaging means.

In one embodiment, the connecting means includes spring means biasing the outer member toward the inner member.

In one embodiment, the connecting means includes a bolt extending through the outer member and along the second axis and threadedly engaging the inner member.

Also in the disclosed embodiments, the securing means includes interengaging means located on the outer member and on the inner member and operable when the outer member is in the first position for causing movement of the inner member in response to movement of the outer member, and means for connecting the outer member to the inner member in the first position, and for selectively permitting movement of the outer member from the first position so as to cause disengagement of the interengaging means The invention also provides a marine propulsion device comprising a mounting bracket adapted to be mounted on the transom of a boat, a propulsion unit mounted on the mounting bracket for pivotal movement relative thereto about a generally vertical steering axis, the propulsion unit including a rotatably mounted propeller and an engine drivingly connected to the propeller by a transmission, a cowl assembly surrounding the engine, the cowl assembly being attached to the propulsion unit and being removable by lateral displacement of the cowl assembly relative to the propulsion unit, and a shift handle assembly including an inner member mounted on the propulsion unit for movement relative thereto, the inner member being connected to the transmission for actuation of the transmission in response to movement of the inner member, an outer member movable between a first position relative to the inner member wherein the outer member interferes with lateral displacement of the cowl assembly, and a second position spaced from the first position wherein the outer member is free of interference with lateral displacement of the cowl assembly, and means for securing the outer member in the first position so as to cause movement of the inner member in response to movement of the outer member, and for selectively permitting movement of the outer member to the second position.

The invention also provides a handle assembly comprising an inner member, an outer member movable between spaced first and second positions relative to the inner member; and means for securing the outer member in the first position so as to cause rotation of the inner member about a first axis and in response to movement of the outer member, and for selectively permitting rotation, about a second axis generally parallel to and spaced from the first axis, of the outer member to the second position.

A principal feature of the invention is the provision of an outboard motor shift handle which can be released and rotated downwardly so as to facilitate removal of the engine cowl assembly.

Another principal feature of the invention is the provision of a handle assembly comprising an inner member, an outer member movable between spaced first and second positions relative to the inner member, and means for securing the outer member in the first position so as to cause rotation of the inner member about a first axis and in response to movement of the outer member, and for selectively permitting rotation, about a second axis generally parallel to and spaced from the first axis, of the outer member to the second position.

Other principal features and advantages of the invention will become apparent to those skilled in the art upon review of the following detailed description, claims, and drawings.

Figure 1:
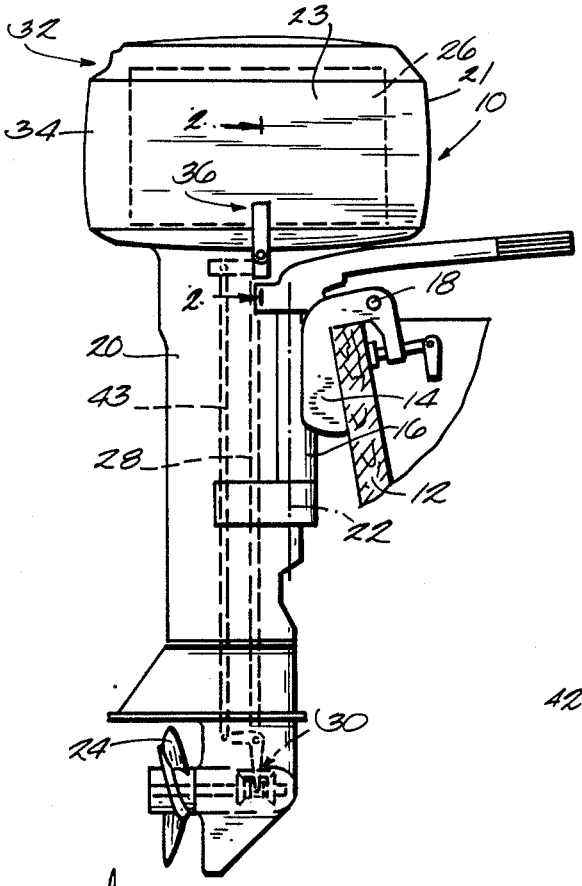
FIG. 1 is a side elevational view of a marine propulsion device which embodies various of the features of the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. As best shown in FIG. 1, the marine propulsion device 10 is an outboard motor comprising a mounting bracket or assembly adapted to be mounted on the transom 12 of a boat. While various suitable mounting brackets can be employed, in the illustrated construction, the mounting bracket or assembly includes a transom bracket 14 fixedly mounted on the transom 12, and a swivel bracket 16 mounted on the transom 14 bracket for pivotal movement relative thereto about a generally horizontal tilt axis 18.

The marine propulsion 10 device further comprises a propulsion unit 20 mounted on the swivel bracket 16 for pivotal movement relative thereto about a generally vertical steering axis 22, and for common movement with the swivel bracket 16 about the tilt axis 18. The propulsion unit 20 includes a front 21, a side 23, a pivotally mounted propeller 24, and an engine 26 drivingly connected to the propeller 24 by a conventional drive train 28 including a transmission 30. In the preferred embodiment, the transmission 30 is reversible and is operable between forward drive and reverse drive engagements.

Figure 3:
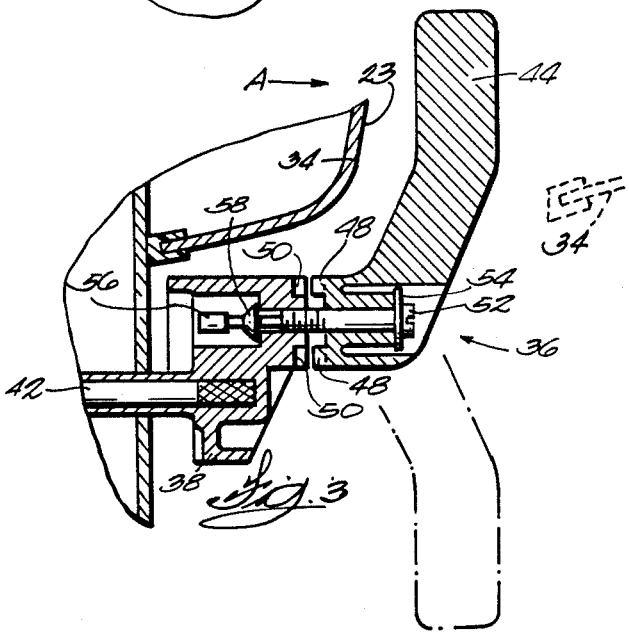
FIG. 3 is a cross-sectional view similar to FIG. 2.
Figure 5:
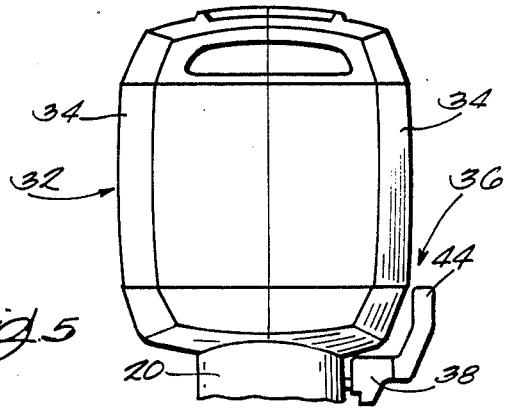
FIG. 5 is a partial rear view of the marine propulsion device.

The marine propulsion device 10 further comprises a cowl assembly 32 surrounding the engine 26. In the preferred embodiment, the cowl assembly 32 includes left and right generally symmetrical cowl members 34 split along a generally vertical plane, as shown in FIG. 5. The cowl members 34 are removed from the propulsion unit 20 by moving the cowl members 34 generally horizontally away from the engine 26, or by displacing the cowl members 34 laterally relative to the propulsion unit 20. Thus, as shown in FIG. 3, the cowl member 34 is movable in the direction of the arrow "A" to expose the engine 26 Such an arrangement is known in the art and need not be described in greater detail.

Figure 2:
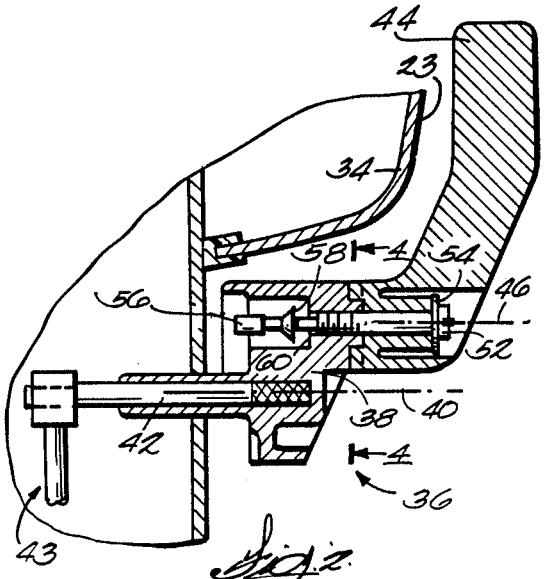
FIG. 2 is a cross-sectional view taken along line 2—2 in FIG. 1.

The marine propulsion device 10 further comprises (see FIG. 2) a shift handle assembly 36 including an inner member 38 mounted on the propulsion unit 20 for movement relative thereto. In the preferred embodiment, the inner member 38 is mounted on the propulsion unit 20 beneath the cowl assembly 32 for rotation about a first generally horizontal axis 40. More particularly, in the illustrated construction, the inner member 38 is fixedly mounted on a shaft 42 which is mounted on the propulsion unit 20 for rotation about the first axis 40. The inner member 38 is connected to the transmission 30 for actuating the transmission 30 in response to movement of the inner member 38. While various suitable connecting arrangements can be employed, in the preferred embodiment, a conventional shift linkage 43 (FIGS. 1 and 2) connects the shaft 42 to the transmission 30 for actuating the transmission 30 in response to rotation of the shaft 42.

The shift handle assembly 36 also includes an outer member 44 movable between spaced first and second positions relative to the inner member 38. In the first position (see FIGS. 1 and 2), the outer member 44 is located adjacent the inner member and extends generally upwardly from the inner member 38 and interferes with lateral displacement of the cowl assembly 32. In the second position (see FIG. 3), the outer member 44 is located in outwardly spaced relation from the first position and the outer member is movable when in the second position between the upwardly extending position shown in full lines in FIG. 3 and a downwardly extending position which is shown in dotted lines in FIG. 3 and which is free of interference with the cowl assembly 32.

The shift handle assembly 36 further includes means for securing the outer member 44 in the first position so as to cause movement of the inner member 38 in response to movement of the outer member 44, and for selectively releasing the outer member 44 from the first position or selectively permitting movement of the outer member 44 to the second position. In the preferred embodiment, the securing means secures the outer member 44 in the first position so as to cause rotation of the inner member 38 about the first axis 40 in response to movement of the outer member 44. Furthermore, in the preferred embodiment, the securing means selectively permits rotation, about a second generally horizontal axis 46 spaced from and parallel to the first axis 40, of the outer member 44 to the second position. It should be understood that, in alternative embodiments of the invention, the inner member 38 can be mounted on the propulsion unit 20 for linear movement relative thereto, the securing means can secure the outer member 44 in a first position so as to cause linear movement of the inner member 38 in response to movement of the outer member 44, and the securing means can selectively permit various types of movement of the outer member 44 to a second position.

While various suitable securing means can be employed, in the preferred embodiment, the securing means includes interengaging means located on the outer member 44 and on the inner member 38 and operable when the outer member 44 is in the first position for causing movement of the inner member 38 in response to movement of the outer member 44. In the preferred embodiment, the interengaging means causes rotation of the inner member 38 in response to movement of the outer member 44.

Figure 4:
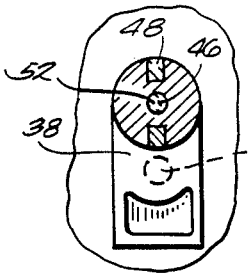
FIG. 4 is a cross-sectional view taken along line 4—4 in FIG. 2.

While various suitable interengaging means can be used, in the illustrated construction, the interengaging means includes (see FIGS. 3 and 4), on the outer member 44, a pair of projections 48 extending toward the inner member 38 in the direction of the second axis 46, and, on the inner member 38, a pair of recesses 50 for receiving the projections 48. The interengaging means are engaged by aligning the projections 48 and recesses 50 and moving the outer member 44 toward the inner member 38 along the second axis 46, and are disengaged (see FIG. 3) by moving the outer member 44 away from the inner member 38 along the second axis 46.

In the preferred embodiment, the securing means also includes means for connecting the outer member 44 to the inner member 38 in the first position, and for selectively permitting movement of the outer member 44 from the first position so as to cause disengagement of the interengaging means. In the preferred embodiment, as shown in FIG. 3, the connecting means permits movement of the outer member 44 along the second axis 46 to cause disengagement of the interengaging means. Thus, in the preferred embodiment, the outer member 44 actually moves both axially (along the second axis 46) and rotationally (about the second axis 46) from the first position to the second position.

While various suitable connecting means can be employed, in the preferred embodiment, the connecting means includes (see FIGS. 2 and 3) a bolt 52 extending through the outer member 44 and along the second axis 46 and threadedly engaging the inner member 38. In the illustrated construction, the connecting means also includes a washer 54 located between the head of the bolt 52 and the outer member 44, and a retainer 56 extending from the inner end of the bolt 52 (the left end in FIG. 2) for preventing removal of the bolt 52 from the inner member 38. The retainer 56 includes a flange portion 58 which engages (see FIG. 3) a shoulder 60 (FIG. 2) on the inner member 38 for limiting outward movement (to the right in FIG. 2) of the bolt 52 relative to the inner member 38. As shown in FIG. 3, the retaining means is constructed such that the bolt 52 can be unscrewed and moved outwardly relative to the inner member 38 just far enough to permit movement of the outer member 44 from the first position so as to cause disengagement of the interengaging means, but not far enough to remove the bolt 52 from threaded engagement with the inner member 38. The outer member 44 is then moved to the second position by rotating it relative to the bolt 52 and to the inner member 38.

It should be noted that, in the preferred embodiment, the outer member 44 is inoperative when in the second position for moving the inner member 38 in response to movement of the outer member 44. However, because the projections 48 and recesses 50 are symmetrical about a horizontal plane including the second axis 46 (a horizontal line in FIG. 4), the outer member 44 can be made operative for moving the inner member 38 simply by moving the outer member 44 inwardly from the second position along the second axis 46. This can be done by screwing in the bolt 52 when the outer member 44 is in the second position. If this capability (upside-down operability of the outer member 44) is undesirable, it can be prevented by making the projections 48 and recesses 50 asymmetrical.

Figure 6:
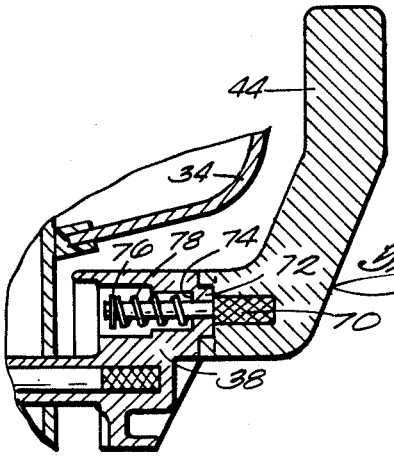
FIG. 6 is a view similar to FIG. 2 showing an alternative embodiment of the invention.

An alternative embodiment of the connecting means is illustrated in FIG. 6. In the alternative embodiment, the connecting means includes spring means biasing the outer member 44 toward the inner member 38 along the second axis 46. More particularly, in the alternative embodiment, the connecting means includes a pin 70 fixedly attached to the outer member 44 and slidably extending through a wall 72 in the inner member 38. The connecting means also includes a flange portion 76 on the inner end of the pin 70, and a spring 78 extending between an inwardly facing shoulder 74 on the inner member 38 and the flange portion 76 for biasing the flange portion 76 away from the shoulder 74, thereby biasing the outer member 44 toward the inner member 38. The outer member 44 is moved to the second position by pulling the outer member 44 outwardly against the force of the spring 78 to disengage the interengaging means, and then by rotating the outer member 44 to the second position.

Various features and advantage of the invention are set forth in the following claims.

We claim:

1. A marine propulsion device comprising a mounting bracket adapted to be mounted on the transom of a boat, a propulsion unit mounted on said mounting bracket for pivotal movement relative thereto about a generally vertical steering axis, said propulsion unit including a rotatably mounted propeller shaft, an engine, and a transmission drivingly connecting said engine to said propeller shaft and operable between forward and reverse drive engagements, and a shift handle assembly including an inner member mounted on said propulsion unit for rotary movement relative thereto about a first axis, said inner member being connected to said transmission for operation of said transmission in response to movement of siad inner member, an outer member movable relative to said inner member and along a second axis in radially spaced and parallel relation to said first axis and between axially spaced first and second positions, and means on said inner and outer members for inter-engagement therebetween when said outer member is in said first position so as to cause transmission operating movement of said inner member in response to movement of said outer member, and for selectively permitting movement of said outer member relative to said inner member and without causing operation of said transmission when said outer member is in second said position.

2. A marine propulsion device as set forth in claim 1 and further including spring means biasing said outer member toward said inner member.

3. A marine propulsion device as set forth in claim 1 and further including a bolt extending through said outer member and along said second axis and threadedly engaging said inner member.

4. A marine propulsion device as set forth in claim 1 and further including spring means biasing said outer member toward said inner member.

5. A marine propulsion device as set forth in claim 1 and further including a bolt extending through said outer member and threadedly engaging said inner member.

6. A marine propulsion device comprising a mounting bracket adapted to be mounted on the transom of a boat, a propulsion unit mounted on said mounting bracket for pivotal movement relative thereto about a generally vertical steering axis, said propulsion unit having a front and a side extending rearwardly from said front, said propulsion unit also including a rotatably mounted propeller shaft, an engine, and a transmission drivingly connecting said engine to said propeller shaft and operable between forward and reverse drive engagements, a cowl member removably attached to said propulsion unit in partially enclosing relation to said engine and being removable from enclosing relation to said engine by lateral displacement thereof relation to said propulsion unit, and a shift handle assembly including an inner member mounted on said propulsion unit about an axis extending laterally from said propulsion unit side and for movement relative thereto and connected to said transmission for operation of said transmission between said forward and rearward drive engagements in response to movement of said inner member, an outer member, and means connecting said outer member to said inner member for selective movement between a first position wherein said outer member extends upwardly into interfering relation to laterally outward displacement of said cowl member from said propulsion unit and wherein movement of said outer member effects transmission operating movement of said inner member, and a second position spaced from said first position and wherein said outer member is free of interference with lateral displacement of said cowl member from said propulsion unit and wherein movement of said outer member is ineffective to produce transmission operating movement of said inner member.

7. A marine propulsion device as set forth in claim 6 wherein said connecting means secures said outer member in said first position relative to said inner member so as to cause rotation of said inner member in response to movement of said outer member.

8. A marine propulsion device comprising a mounting bracket adapted to be mounted on the transom of a boat, a propulsion unit mounted on said mounting bracket for pivotal movement relative thereto about a generally vertical steering axis, said propulsion unit including a rotatably mounted propeller shaft, an engine, and a transmission drivingly connecting said engine to said propeller shaft and operable between forward and reverse drive engagements, a cowl member removably attached to said propulsion unit in partially enclosing relation to said engine and being removable from enclosing relation to said engine by lateral displacement thereof relative to said propulsion unit, and a shift handle assembly including an inner member mounted on said propulsion unit for rotation relative thereto about a first axis and connected to said transmission for operation of said transmission between said forward and rearward drive engagements in response to movement of said inner member, an outer member, and means connecting said outer member to said inner member for selective rotation about a second axis generally parallel to and spaced radially from said first axis, and between a first position wherein said outer member extends upwardly into interfering relation to laterally outward displacement of said cowl member from said propulsion unit and wherein said outer member is secured to said inner member so as to cause rotation of said inner member in response to rotation of said outer member to effect operation of said transmission, and a second position spaced from said first position and wherein said outer member is free of interference with lateral displacement of said cowl member from said propulsion unit and wherein movement of said outer member is ineffective to produce transmission operating movement of said inner member.

9. A marine propulsion device as set forth in claim 8 wherein said connecting means includes interengaging means located on said outer member and on said inner member and operable when said outer member is in said first position for causing rotation of said inner member in response to movement of said outer member, and means for connecting said outer member to said inner member in said first position, and for selectively permitting movement of said outer member from said first position and along said second axis so as to cause disengagement of said interengaging means.

10. A marine propulsion device as set forth in claim 9 wherein said connecting means includes spring means biasing said outer member toward said inner member.

11. A marine propulsion device as set forth in claim 9 wherein said connecting means includes a bolt extending through said outer member and along said second axis and threadedly engaging said inner member.

12. A marine propulsion device comprising a mounting bracket adapted to be mounted on the transom of a boat, a propulsion unit mounted on said mounting bracket for pivotal movement relative thereto about a generally vertical steering axis, said propulsion unit including a rotatably mounted propeller, an engine, and a transmission drivingly connecting said engine to said propeller and operable between a forward drive engagement and and a rearward drive engagement, a cowl member removably attached to said propulsion unit in partially enclosing relation to said engine and being removable from enclosing relation to said engine by lateral displacement thereof relative to said propulsion unit, and a shift handle assembly including an inner member mounting on said propulsion unit beneath said cowl member for rotation about a first laterally extending generally horizontal axis, said inner member being connected to said transmission for operation of said transmission between said forward and rearward drive engagements in response to rotation of said inner member about said first axis, an outer member, and means connecting said inner and outer members for selective movement of said outer member relative to said inner member along a second axis in radially spaced and parallel relation to said first axis and between a first position wherein said outer member is adjacent to said inner member and extends generally upwardly from said inner member and into interferring relation to laterally outward displacement of said cowl member and a second position spaced laterally along said second axis from said first position and wherein said outer member is rotatable about said second axis between the upwardly extending position interferring with lateral displacement of said cowl member and a downwardly extending position free of interference with lateral displacement of said cowl member.

13. A handle assembly comprising an inner member rotatable about a first axis, an outer member, means connecting said outer member and said inner member for displacement of said outer member to and from said inner member and along a second axis located in radially spaced and parallel relation to said first axis and between a first position adjacent said inner member and a second position spaced relative to said inner member outwardly from said first position, and selectively interengageable means on said inner and outer members and located, when said outer member is in said first position, in engaged condition to prevent relative rotation between said inner and outer members about said second axis, whereby to afford rotation of said inner member about said first axis in response to movement of said outer member, and located, when said outer member is in said second position, in disengaged condition to permit rotation of said outer member about said second axis relative to said inner member between angularly spaced positions.

14. A handle assembly as set forth in claim 13 and further including spring means biasing said outer member toward said inner member.

15. A handle assembly as set forth in claim 13 and further including a bolt extending through said outer member and along said second axis and threadedly engaging said inner member.

* * * * *